US005437314A

United States Patent [19]

Sainen

[11] Patent Number: 5,437,314

[45] Date of Patent: Aug. 1, 1995

[54] WARP FEED CONTROLLER HAVING TENSION DETECTORS FOR USE IN TWIN BEAM WEAVING MACHINE

[75] Inventor: Tsutomu Sainen, Kanazawa, Japan

[73] Assignee: Tsudakoma Kogyo Kabushiki Kaisha, Kanazawa, Japan

[21] Appl. No.: 240,564

[22] Filed: May 11, 1994

[30] Foreign Application Priority Data

May 11, 1993 [JP] Japan ..... 5-109566

[51] Int. Cl.[6] ..... D03D 49/06

[52] U.S. Cl. ..... 139/103

[58] Field of Search ..... 139/101, 102, 103, 194; 28/185

[56] References Cited

U.S. PATENT DOCUMENTS

| | | | |
|---|---|---|---|
| 4,662,407 | 5/1987 | Duncan | 139/103 |
| 5,014,756 | 5/1991 | Vogel et al. | 139/102 |
| 5,261,465 | 11/1993 | Dore | 139/103 |
| 5,305,802 | 4/1994 | Fehrenbach | 139/103 |

FOREIGN PATENT DOCUMENTS

| | | | |
|---|---|---|---|
| 527705 | 2/1993 | European Pat. Off. | 139/103 |
| 0572753 | 12/1993 | European Pat. Off. . | |
| 61-180184 | 11/1986 | Japan . | |
| 2-46504 | 10/1990 | Japan . | |
| 2009260 | 6/1979 | United Kingdom . | |

OTHER PUBLICATIONS

Patent Abstracts of Japan, vol. 8, No. 177 (M-317)(1614), Aug. 15, 1984 & JP-A-59 069 360, Apr. 19, 1984.

Database WPI, Derwent Publications Ltd., AN 94 128538, JP-A-6 057588, Mar. 1, 1994.

*Primary Examiner*—Andrew M. Falik

*Attorney, Agent, or Firm*—Oblon, Spivak, McClelland, Maier & Neustadt

[57] ABSTRACT

A warp feed controller for use in a twin beam weaving machine having a first tension detector for detecting the tension of at least one of the groups of warp yarns fed in sheet-like forms from a pair of warp beams and a first control system for controlling the rotation of one of the warp beams on the basis of the tension deviation from a target tension under detection of the tension by the tension detector. The controller also includes a pair of second tension detectors for detecting the tensions of the warp yarns fed from the warp beams in boundary portions of the sheet-like forms, and a second control system for controlling the rotation of the other of the warp beams on the basis of the tension difference output from the second tension detectors, respectively. The first control system controls the one warp beam so that the tension of the warp yarns becomes equal to a target tension, while the second control system controls the other warp beam so that the tensions of warp yarns in the boundary portions become equal to each other.

5 Claims, 6 Drawing Sheets

WARP FEED CONTROLLER HAVING TENSION DETECTORS FOR USE IN TWIN BEAM WEAVING MACHINE

BACKGROUND OF THE INVENTION

1.Field of the Invention

This invention relates to a twin-beam weaving machine using a pair of left and right warp beams to weave a textile fabric having a large breadth and, more particularly, to a warp feed controller of a twin beam weaving machine designed to reliably prevent the occurrence of a wale streak defect in a central portion of a fabric.

2. Description of the Related Art

Weaving machines capable of weaving a textile fabric having a large breadth by a pair of left and right warp beams have been known as twin beam weaving machines.

In such twin beam weaving machines, if tensions of warp yarns from the warp beams are unbalanced, a noticeable wale streak occurs in a warp boundary portion, i.e., a central portion of the fabric. Twin beam weaving machines therefore require a special means devised to balance the tensions of warp yarns fed from the warp beams (for example, as in the weaving machine disclosed in Japanese Utility Model Laid-Open No. Sho 61-180184.

For example, the difference between two groups of warp yarns from the warp beams may be canceled by detecting the tensions of the warp yarns fed from the warp beams with tension detectors when the left and right beams are driven through a differential gear mechanism connected to a common drive shaft, and by braking one or both the warp beams on the basis of tension signals from the tension detectors. That is, the tension detectors are disposed at positions corresponding to two side end portions of a fabric, the tension signals from the tension detectors are compared by a comparison control means, and the braking force of brakes interposed between the differential gear mechanism and the warp beams are controlled according to the result of the comparison.

This prior art entails the problem of difficulty in completely preventing occurrence of a wale streak in a central portion of a fabric, because the tensions of warp yarns from the warp beams are measured at positions corresponding to two side end portions of the fabric.

That is, in general, the tensions of warp yarns are not always constant in the widthwise direction of the warp beams, they are liable to be smatter in side end portions of a fabric and to be larger in a central portion of the fabric, and the magnitude of variation in tension ordinarily disperses with respect to warp beams. This is because weft yarns tend to be looser in side end portions of the fabric so that the amount of consumption of warp yarns is smaller, because dispersions of slashed states and dispersions of the wound hardness in a preparatory step with respect to warp beams are not negligible, because mechanisms for applying tensile forces to warp yarns from the left and right warp beams cannot always tense the warp yarns completely evenly, and for other reasons. Accordingly, even if the difference between the tensions of warp yarns in opposite end portions of a fabric could be eliminated, the elimination of the difference between the warp tensions in these portion does not always mean the elimination of the difference between the warp tensions in a warp boundary portion.

SUMMARY OF THE INVENTION

In view of these problems, an object of the present invention is to provide a warp feed controller of a twin beam weaving machine which has tension detectors for detecting tensions of warp yarns from left and right warp beams at the warp boundary and first and second control systems and which can effectively prevent occurrence of a wale streak by using such means so as to eliminate the difference between the tensions of the warp yarns in a central portion of a fabric while constantly maintaining the total tension of the warp yarns.

To achieve this object, according to the present invention, there is provided a warp feed controller for use in a twin beam weaving machine having a pair of left and right warp beams for feeding two groups of warp yarns each in a sheet-like form, the warp feed controller comprising tension detection means for detecting the tension of at least one of the groups of warp yarns fed from the pair of warp beams, a first control system for controlling the rotation of one of the warp beams on the basis of the tension deviation from a target tension under detection of the tension by said tension detection means, a pair of tension detectors for detecting the tensions of the groups of warp yarns fed from the warp beams and joining with each other, the tension of each group of warp yarns being detected in a boundary portion of the sheet-like form, and a second control system for controlling the rotation of the other of the warp beams on the basis of the difference of the tension output from the tension detectors, respectively.

The arrangement may be such that the tension detection means detects the tensions of the groups of warp yarns fed from the pair of warp beams, the first control system performs a correction control on the basis of the tension difference deteting the second control system, and the second control systems performs a correction control on the basis of a tension deviation in the first control system.

In this arrangement of the present invention, the tension detectors detect the tensions of warp yarns in boundary portions of the sheets of warp yarns from the warp beams, and the second control system can operate by following the operation of the first control system as a master control system on the basis of tension signals from the tension detectors. That is, the second control system controls the rotation of the corresponding one of warp beam so that this warp beam follows the warp beam whose rotation is controlled through the first control system, and so that the difference between the tensions of warp yarns in the boundary portions of the two sheets of warp yarns becomes zero.

Also when the first control system performs a control correction on the basis of the warp tension difference and when the second control system performs a correction control on the basis of a tension deviation, the entire system can operate so that the tension difference as between warp boundary portions becomes zero.

The above, and other objects, features and advantages of the present invention will become apparent from the following description when the same is read in conjunction with the accompanying drawings, in which like reference numerals designate the same elements.

DESCRIPTION OF THE PREFERRED EMBODIMENTS

Figure 1:
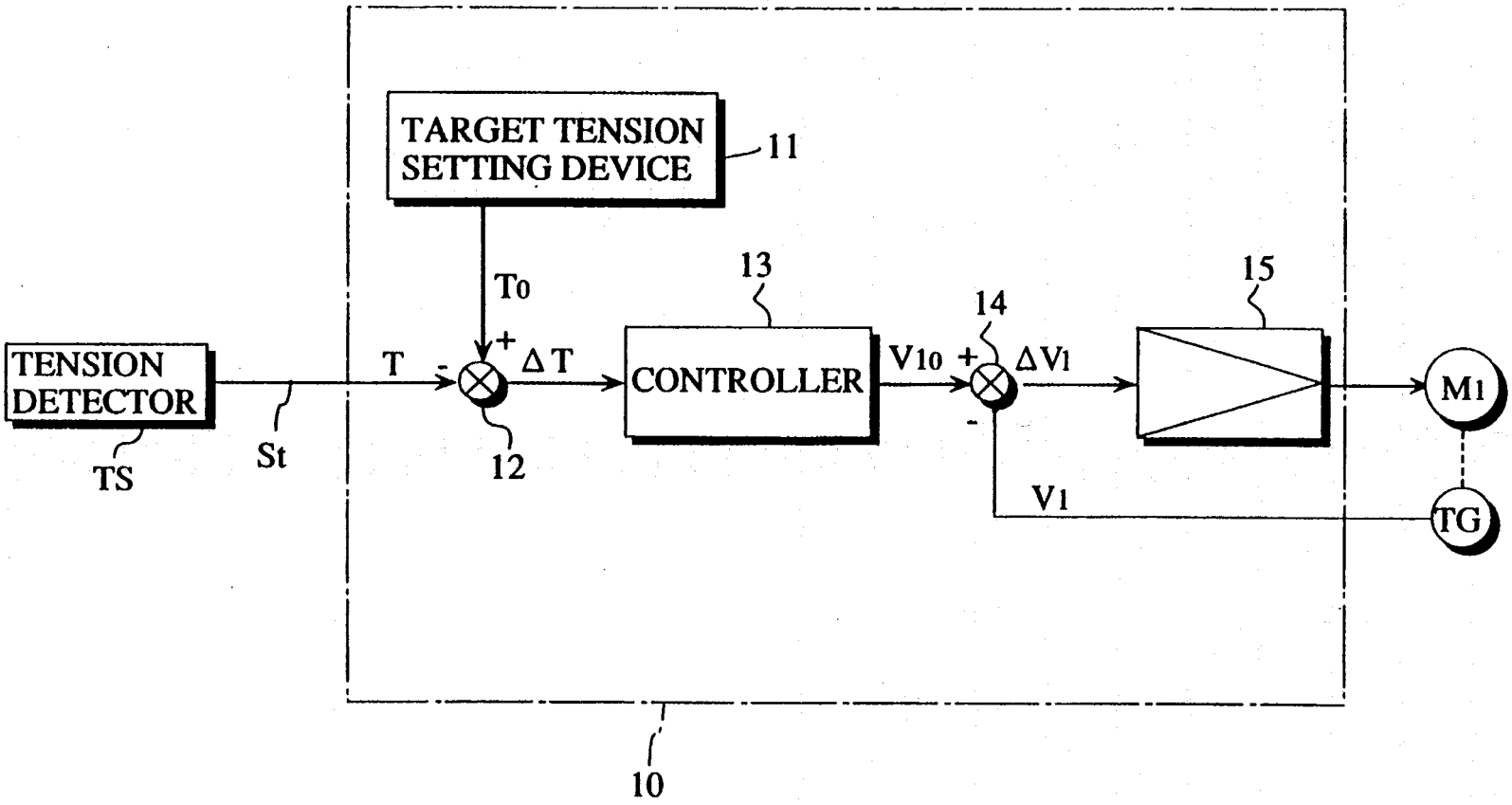
FIG. 1 is a block diagram of an essential portion of a first embodiment of the present invention, schematically showing the configuration of a first control system.
Figure 2:
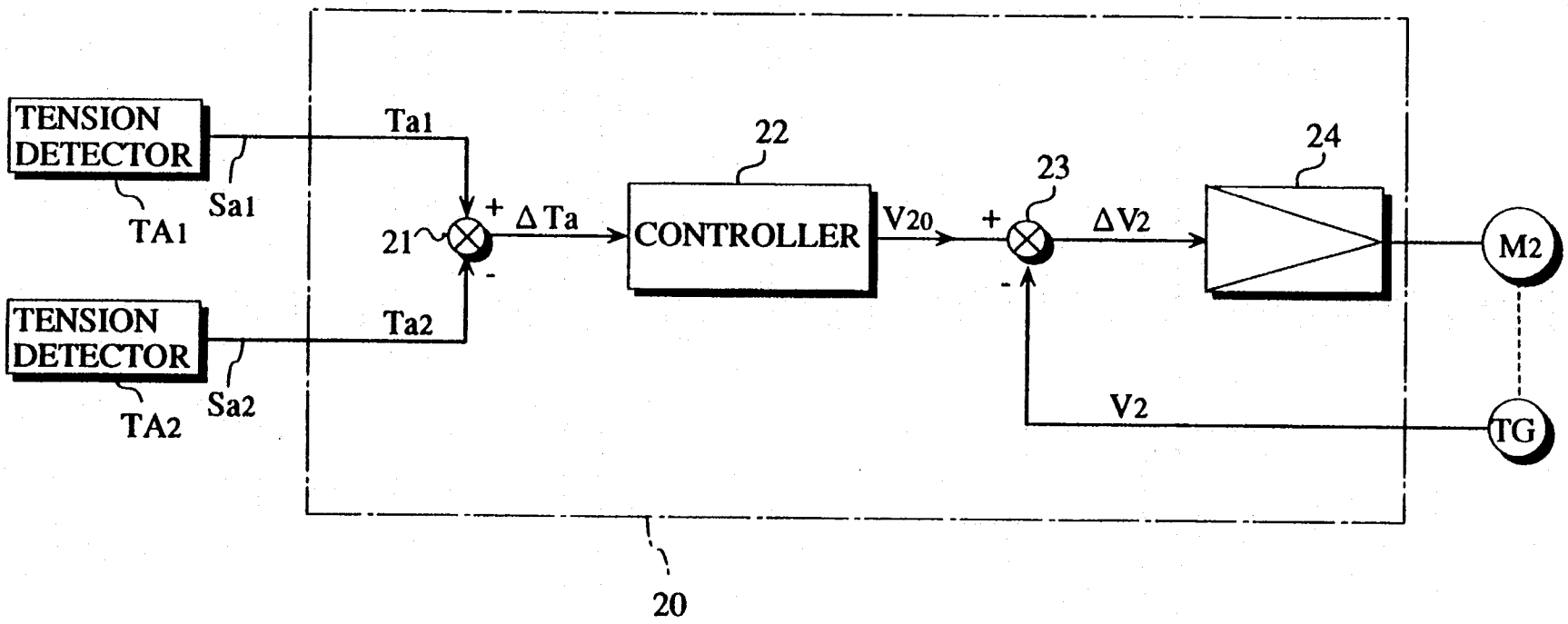
FIG. 2 is a block diagram of another essential portion of the first embodiment of the present invention, schematically showing the configuration of a second control system.

Referring to FIGS. 1 and 2, a warp feed controller for use in a twin beam weaving machine controls the rotation of feed motors M1 and M2 through first and second control systems 10 and 20.

Figure 3:
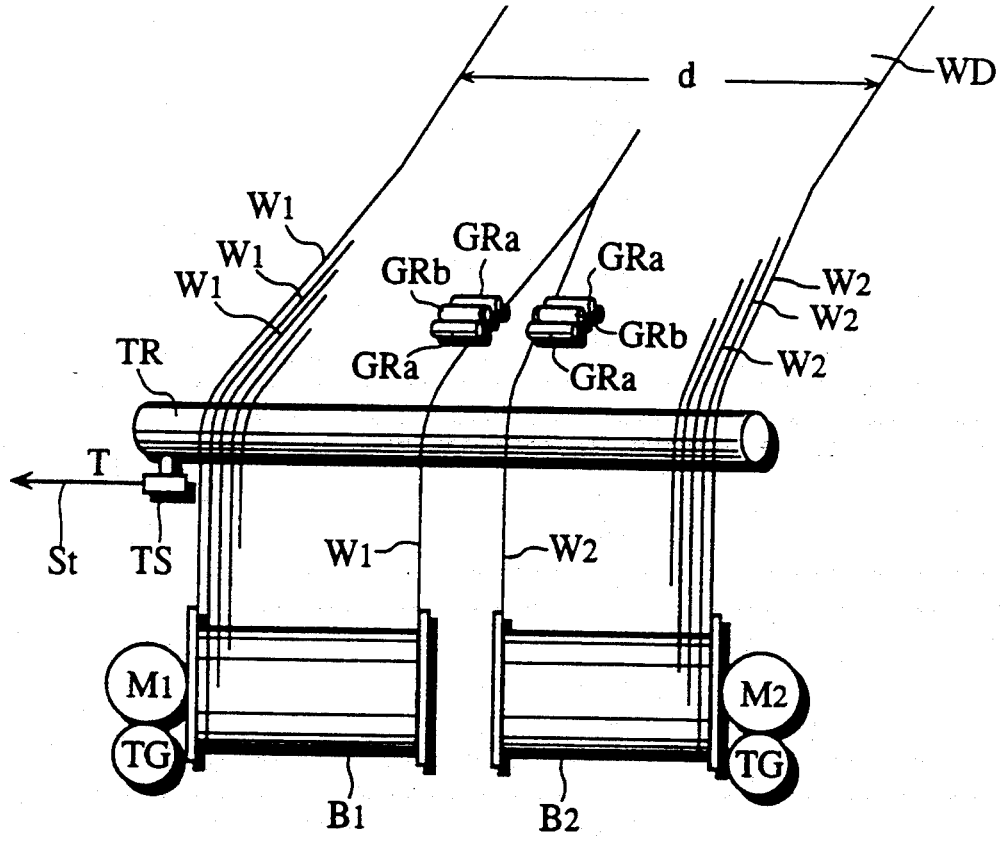
FIG. 3 is a perspective view of an example of an application of the present invention to a twin beam weaving machine.

As shown in FIG. 3, the twin beam weaving machine has left and right warp beams B1 and B2, and groups of warp yarns W1 . . . W1 and W2 . . . W2 fed from the left and right warp beams are drawn out each in a sheet-like form by a common tension roller TR and join to form one warp sheet WD. Thereafter, by inserting weft yarns (not shown), one fabric is woven. The feed motors M1 and M2 are respectively connected to the warp beams B1 and B2, and are provided with tachometer generaters TG for detecting the rotational speeds thereof.

A tension detector TS is provided at one end the tension roller TR. The tension detector TS is formed of, for example, a load cell device, and serves to detect a total tension T of the warp yarns W1 . . . W1 and W2 . . . W2 from the left and right warp beams B1 and B2 by detecting a force loaded on the tension roller TR to output the total tension T as a tension signal St. Since the tension detector TS is provided at one end of the tension roller TR, it detects about e,fra 1/2 × of the total tension T. Therefore, the tension signal St should be formed to represent a value about twice as large as the tension detected by the tension detector TS.

Figure 4:
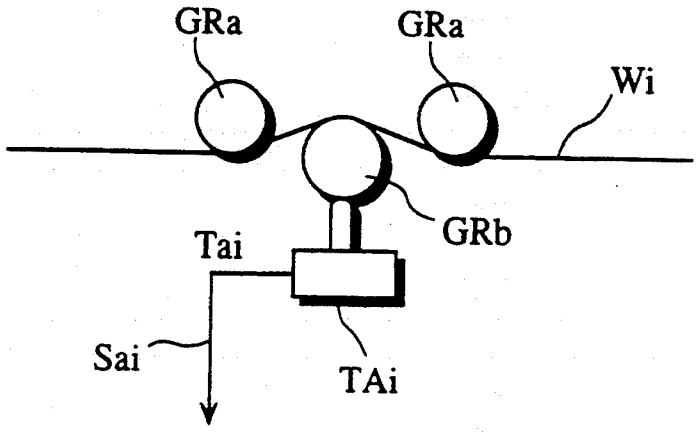
FIG. 4 is a schematic side view of the arrangement of a tension detector TAi in accordance with the present invention.

A pair of tension detectors TAi (i=1, 2) are provided at boundary portions of the sheets of warp yarns W1 . . . W1 and W2 . . . W2 from the warp beams B1 and B2 (see FIGS. 3 and 4).

A pair of fixed guide rollers GRa, GRa and a movable guide roller GRb are disposed at the boundary portion of each of the sheets of warp yarns W1 . . . W1 and W2 . . . W2 fed from the warp beams B1 and B2 so as to engage with a suitable number of warp yarns Wi (i=1, 2) positioned in the boundary portion.

Each of the tension detectors TAi can detect a tension Tai (i=1, 2) of the warp yarns Wi by detecting the force loaded on the corresponding guide roller GRb and output the detected tension Tai as tension signals Sai (i=1, 2).

Referring back to FIG. 1, the first control system 10 controls the rotation of one warp beam B1 by controlling the corresponding feed motor M1 on the basis of the tension signal St from the tension detector TS. That is, the tension signal St output from the tension detector TS is supplied to a subtraction terminal of to a combining point 12, while a target tension $T_0$ set in a target tension setting device 11 is supplied to an addition terminal to the combining point 12. An output from the combining point 12 is connected to the feed motor M1 through a controller 13, a combining point 14 and a differential amplifier 15. An output from the tachometer generater TG connected to the feed motor M1 is fed back to the combining point 14.

Referring to FIG. 2, the second control system 20 controls the rotation of the other warp beam B2 by controlling the corresponding feed motor M2 on the basis of the tension signals Sai from the tension detectors TAi. That is, the tension signals Sai output from the tension detectors TAi are respectively supplied to addition and subtraction terminals to a combining point 21, and an output from the combining point 21 is connected to the feed motor M2 through a controller 22, a combining point 23 and a differential amplifier 24. An output from the tachometer generater TG connected to the feed motor M2 is fed back to the combining point 23.

Assuming that the target tension $T_0$ with respect to the total tension T of the warp yarns W1 . . . W1 and W2 . . . W2 from the warp beams B1 and B2 is set in the target tension setting device 11 of the first control system 10, a tension deviation $\Delta T = T_0 - T$ is obtained as the output from the combining point 12. The controller 13 then calculates a speed command value $V1_0$ for the feed motor M1 on the basis of the tension deviation $\Delta T$ and outputs this value to the combining point 14. On the other hand, the rotational speed V1 of the feed motor M1 is fed back to the combining point 14. Therefore, a speed deviation $\Delta V1 = V1_0 - V1$ can be output from the combining point 14. Accordingly, the differential amplifier 15 can control the rotation of the feed motor M1 so that the speed deviation $\Delta V1 = 0$. That is, the first control system 10 controls the rotation of the warp beam B1 so that the total tension T becomes equal to the target tension $T_0$.

On the other hand, in the second control system 20, the tension difference $\Delta Ta = Ta1 - Ta2$ in the boundary portions of the sheets of the warp yarns W1 . . . W1 and W2 . . . W2 from the warp beams B1 and B2 are calculated at the combining point 21 and this tension difference is output to the controller 22. The controller 22 calculates a speed command value $V2_0$ on the basis of the tension difference $\Delta Ta$ and outputs this value to the combining point 23. Then the differential amplifier 24 can control the rotational speed V2 of the feed motor M2 so that the speed deviation $\Delta V2 = V2_0 - V2 = 0$. The second control system 20 controls the rotation of the warp beam B2 so that the tension difference $\Delta Ta = 0$ as a whole, that is, the tensions Ta1 and Ta2 in boundary portions are equal to each other. Tensions Tw of the warp yarns W1 and W2 from the warp beams B1 and B2 have a distribution in the widthwise direction d of the warp sheet WD, such as that shown in FIG. 5. That is, the first control system 10 can perform such a control that average tensions Tm1 and Tm2 of the warp yarns W1 . . . W1 and W2 . . . W2 from the warp beams B1 and B2 are approximately equal to $T_0/(2n)$, while the second control system 20 can perform such a control that Ta1 = Ta2 at a boundary K between the groups of warp yarns W1 . . . W1 and W2 . . . W2. The above symbol n represents the number of warp yarns W1 or W2 from each of the warp beams B1 and B2.

Figure 5:
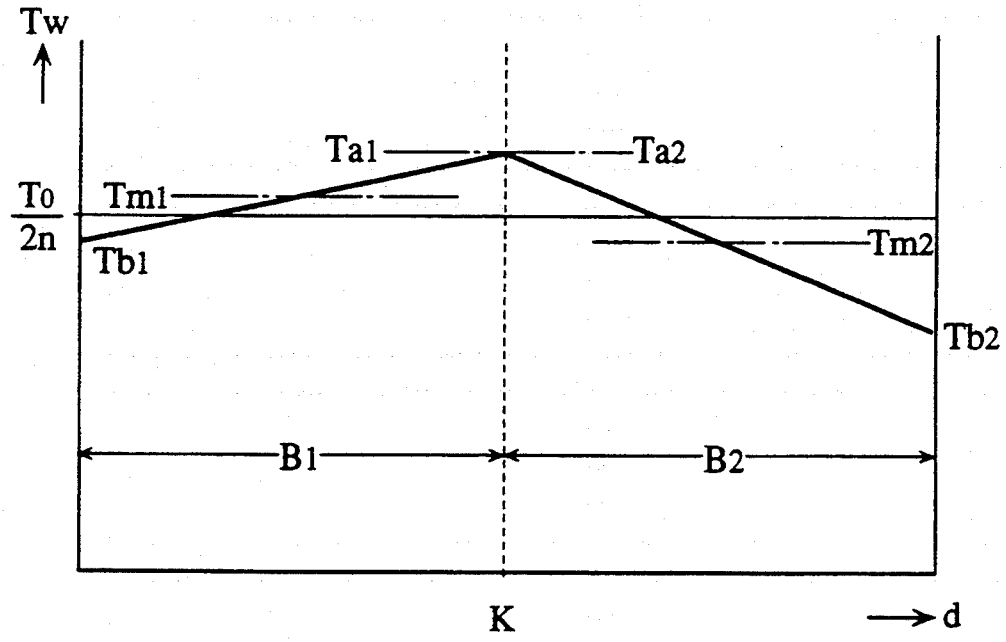
FIG. 5 is a diagram of a tension distribution in warp yarns in accordance with the present invention.

As shown in FIG. 5, minimum tensions Tb1 and Tb2 of the warp yarns W1 . . . W1 and W2 . . . W2 from the warp beams B1 and B2 occur at the two side ends of the warp sheet WD, while maximum tensions Ta1 and Ta2 occur at the boundary K. This is due to a condition in which wefts inserted into the warp sheet WD are liable to be looser at the two side ends of the fabric and to be tighter in a central portion of the fabric in the shuttleless weaving machine, and in which, accordingly, the amount of consumption of warp yarns in the fabric is smaller in the side end portions and Is larger in the central portion. In the arrangement of this embodiment, Ta1=Ta2 is obtained at the boundary K, thereby preventing occurrence of a wale streak in the central portion of the fabric. On the other hand, the total tension T of the warp yarns W1 . . . W1 and W2 . . . W2 can be set to be equal to the target tension $T_0$ even if the magnitudes of tension variation Td1 −Ta1−Tb1 and Td2=Ta2−Tb2 with respect to the warp beams B1 and B2 are large. Therefore, the resulting fabric is free from the occurrence of a considerable defect at any position.

As the tension detector TS which inputs tension signal St to the first control system 10, any tension detection means other than that shown in FIG. 3 may be used, as long as the tension T1 of warp yarns W1 . . . W1 from at least one of the left and right warp beams B1 and B2 can be detected, as shown in FIGS. 6(A) through 6(D).

Figure 6A:
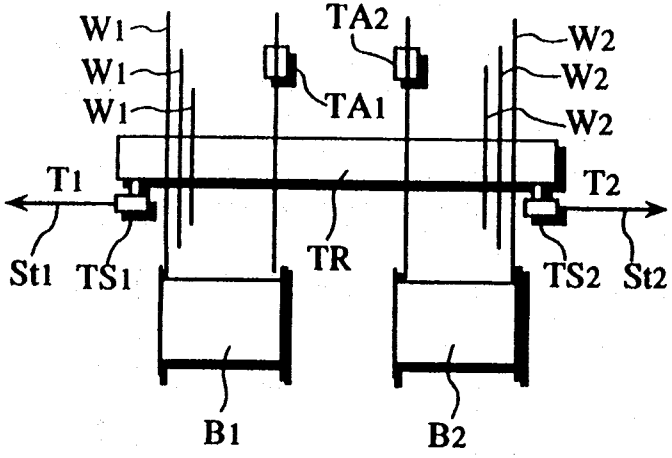
FIGS. 6(A) through 6(D) are schematic diagrams of other examples of the arrangement of tension detectors in accordance with the present invention.

For example, the arrangement may be such that tension detectors TS1 and TS2 are provided at the two side ends of the common tension roller TR (FIG. 6(A)), and the sum of tension signals St1 and St2 from the tension detectors TS1 and TS2, representing the total tension T=T1+T2 of tensions T1 and T2 detected by the tension detectors TS1 and TS2, is used as the tension signal St to be input to the first control system 10.

Figure 6B:
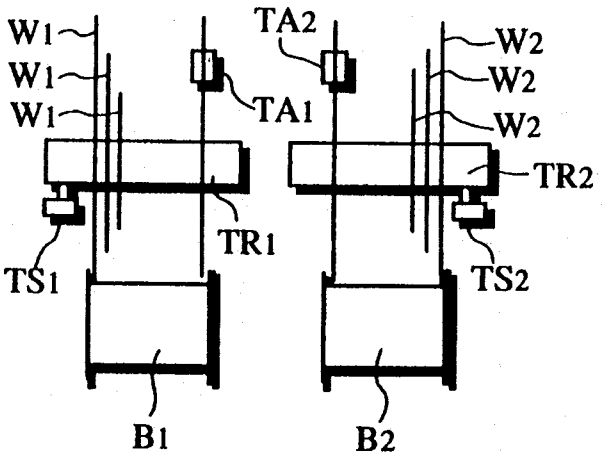

The arrangement may alternatively be such that independent tension rollers TR1 and TR2 are provided in association with the warp beams B1 and B2 (FIG. 6(B)), tension detectors TS1 and TS2 are provided in correspondence with the tension rollers TR1 and TR2, and the sum of tension signals St1 and St2 from the tension detectors TS1 and TS2 is used.

Figure 6C:
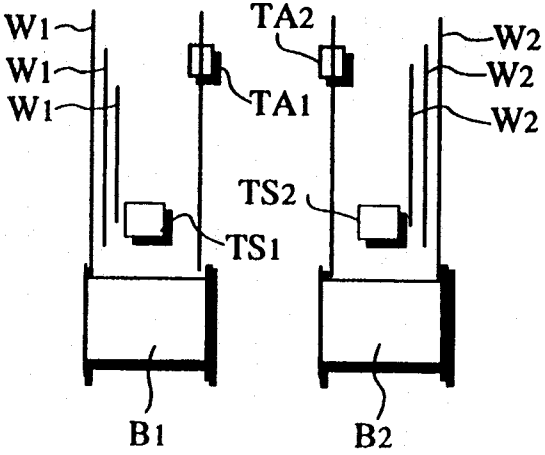

Further, the arrangement may be such that tension detectors TS1 and TS2 are used in the same manner as the tension detectors TA1 and TA2 at the boundary portions while no tension roller is used, and the sum of tension signals St1 and St2 from the tension detectors TS1 and TS2 is used (FIG. 6(C)). Preferably, in this case, the tension detectors TS1 and TS2 are disposed substantially at centers of the sheets of warp yarns W1 . . . W1 and W2 . . . W2 from the warp beams B1 and B2 to detect average tensions Tm1 and Tm2 of the warp yarns W1 . . . W1 and W2 . . . W2.

Figure 6D:
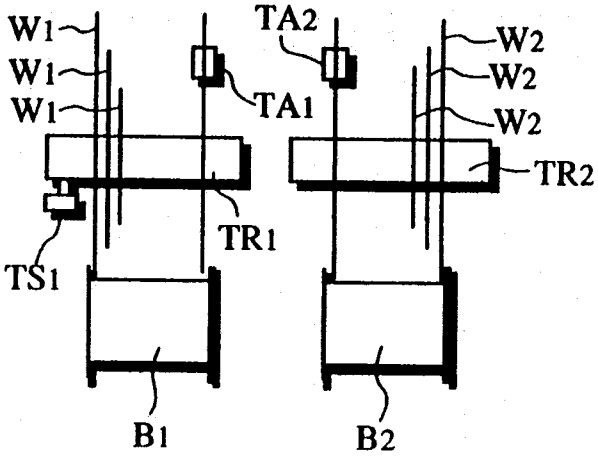

A tension detector TS1 may be provided at only one tension roller TR1 corresponding to the warp beam B1 (FIG. 6(D)). In this case, the first control system 10 controls the warp beam B1 only on the basis of the tension T1 of warp yarns W1 . . . W1 from the warp beam B1.

The control configuration of FIG. 6(D) can also be realized by using the arrangement of FIG. 6(A), because the tension signals St1 and St2 from the tension detectors TS1 and TS2 can be processed by a suitable operation to be converted into a signal which represents only the tension T1 of warp yarns W1 . . . W1 from the warp beam B1 and which is input to the first control system 10 (see Japanese Patent Publication No. Hei 2-46504). Further, the control configuration of FIG. 6(D) can be realized by using the arrangement of FIG. 6(C).

Figure 7:
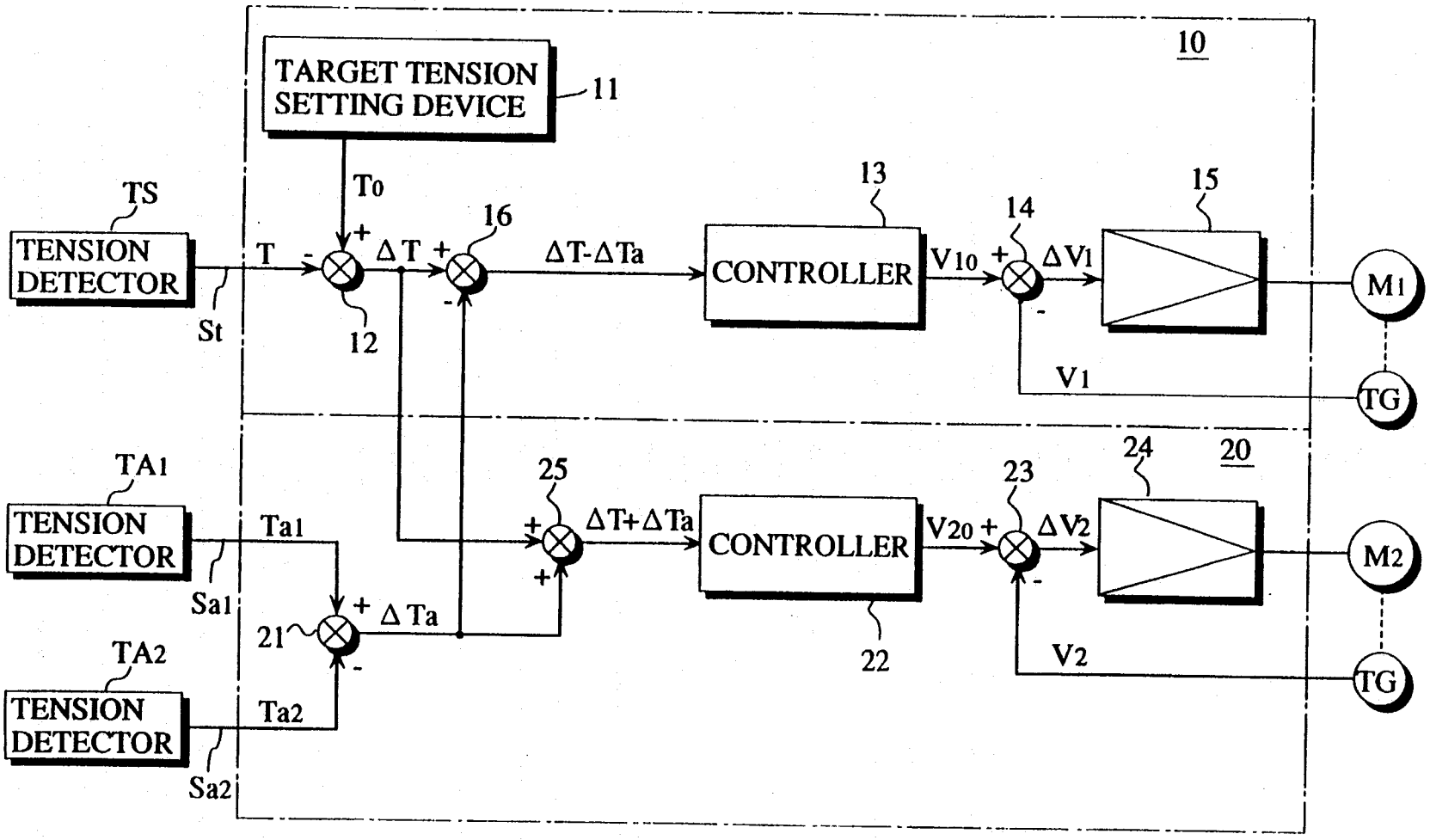
FIG. 7 is a block diagram of another embodiment of the present invention.

The warp feed controller may alternatively be arranged in accordance with another embodiment of the present invention as shown in FIG. 7 to enable the control system 10 to perform a correction control on the basis of the tension difference ΔTa in the boundary portions and the second control system 20 to perform a correction control on the basis of the tension deviation ΔT in the first control system 10.

In more detail, in the first control system 10, another combining point 16 is interposed between the combining point 12 and the controller 13, and the tension difference ΔTa from the second control system 20 is supplied to a subtraction terminal to the combining point 16. In the second control system 20, a combining point 25 is interposed between the combining point 21 and the controller 22, and the tension deviation ΔT from the first control system 10 is supplied to an addition terminal to the combining point 25. In this case, the tension detector TS which inputs tension signal St to the first control system 10 should be arranged as shown in FIG. 3 or as the tension detection means shown in FIG. 6(A), 6(B) or 6(C). This is because in this case it is necessary for the tension detection means to detect the total tension T of warp yarns W1 . . . W1 and W2 . . . W2 from the left and right warp beams B1 and B2.

The first and second control systems 10 and 20 can perform correction controls of the feed motor M1 and M2 in the direction of reducing the tension deviation ΔT when there is no tension difference ΔTa, and can therefore equalize the tensions Ta1 and Ta2 in the boundary portions of the sheets of warp yarns W1 . . . W1 and W2 . . . W2.

In each of the above-described embodiments, the feed motors M1 and M2, which are control objects, can, of course, be interchanged with respect to the first and second control systems 10 and 20. In such a case, however, the connections of the tension detectors TA1 and TA2 to the combining point 21 in the second control system 20 are interchanged and the tension detector TS1 of FIG. 6(D) is provided on the tension roller TR2 side.

According to the present invention, as described above, there are provided a tension detection means, a first control system for controlling the rotation of one of two warp beams, tension detectors for detecting the tensions of two sheets of warp yarns from the warp beams in boundary portions of the sheets of warp yarns, and a second control system for controlling the rotation of the other warp beam on the basis of tension signals from the tension detectors. The warp beams can be thereby controlled so that the tensions in the boundary portions of the sheets of warp yarns are equalized while the total tension of the warp beams is maintained at a target tension. It is therefore possible to prevent occurrence of a considerable wale streak in a central portion of a resulting fabric.

What is claimed is:

1. A warp feed controller for use in a twin beam weaving machine having a pair of left and right warp beams for feeding two groups of warp yarns each in a sheet-like form, said warp feed controller comprising:

tension detection means for detecting a tension of at least one of the groups of warp yarns fed from the pair of warp beams;

a first control system for controlling a rotation of one of the warp beams on the basis of a tension deviation from a target tension under detection of the tension by said tension detection means;

a pair of tension detectors for detecting tensions of the groups of warp yarns fed from the warp beams and joining with each other, the tension of each group of warp yarns being detected in a boundary portion of the sheet-like form; and a second control system for controlling a rotation of the other of the warp beams on the basis of a tension difference output from said tension detectors, respectively.

2. A warp feed controller according to claim 1, wherein said tension detection means detects the tensions of the groups of warp yarns fed from the pair of warp beams, said first control system is adapted to correct the control of the rotation of said one of the warp beams on the basis of the tension difference output from said tension detectors, and said second control system is adapted to correct the control of the rotation of the other of the warp beams on the basis of the tension deviation in said first control system.

3. A warp feed controller according to claim 1 or 2, having a common tension roller for applying a tensile force to each of the groups of warp yarns fed from the pair of warp beams, wherein said tension detection means is provided at least at one end of said tension roller to detect a load imposed upon the tension roller as the tension of said groups of warp yarns.

4. A warp feed controller according to claim 1, having separate tension rollers disposed so as to face said pair of warp beams and capable of independently applying tensile forces to the groups of warp yarns fed from said warp beams, wherein said tension detection means detects, as the tension of said groups of warp yarns, a load imposed upon an end portion symmetrically disposed with the boundary line of the warp yarns of at least one of said separate tension rollers.

5. A warp feed controller according to claim 1 or 2, wherein said tension detection means are adapted to be disposed nearly at centers of the groups of warp yarns fed in sheet-like forms from said warp beams to detect the sum of the tensions of warp yarns fed from the warp beams.

* * * * *